US007000592B2

(12) United States Patent
Katsuragawa et al.

(10) Patent No.: US 7,000,592 B2
(45) Date of Patent: Feb. 21, 2006

(54) THROTTLE DEVICE FOR MULTIPURPOSE ENGINE

(75) Inventors: Shinichi Katsuragawa, Wako (JP); Takao Tamechika, Wako (JP); Tomoki Fukushima, Wako (JP); Hayato Matsuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/923,824

(22) Filed: Aug. 24, 2004

(65) Prior Publication Data

US 2005/0045148 A1 Mar. 3, 2005

(30) Foreign Application Priority Data

Aug. 29, 2003 (JP) ..... 2003-307412
Aug. 29, 2003 (JP) ..... 2003-307414

(51) Int. Cl.
*F02D 7/00* (2006.01)

(52) U.S. Cl. ..... 123/396; 123/198 DC

(58) Field of Classification Search ..... 123/337, 123/396, 399, 198 DB, 198 DC, DIG. 11
See application file for complete search history.

(56) References Cited

U.S. PATENT DOCUMENTS 6,009,853 A * 1/2000 Fujikawa et al. ..... 123/396
6,039,027 A * 3/2000 Sato et al. ..... 123/399
6,155,533 A * 12/2000 Semeyn et al. ..... 251/129.12
6,213,083 B1 * 4/2001 Winberg ..... 123/198 DB
6,341,593 B1 * 1/2002 Kamimura et al. ..... 123/337
6,488,009 B1 * 12/2002 Sakurai et al. ..... 123/399
6,820,590 B1 * 11/2004 Muraji ..... 123/399

FOREIGN PATENT DOCUMENTS

JP 2001-263098 9/2001
JP 2003-083093 3/2003
JP 2003-120422 4/2003

* cited by examiner

*Primary Examiner*—Mahmoud Gimie
(74) *Attorney, Agent, or Firm*—Westerman, Hattori, Daniels & Adrian, LLP

(57) ABSTRACT

In a throttle device for a multipurpose internal combustion engine having a throttle valve connected to an electric motor and a carburetor, when an instruction to stop the engine is inputted, the electric motor is controlled to move the throttle valve in a fully closed position so as to stop the engine, and then to move the throttle valve in a fully opened direction. With this, throttle valve can be surely opened to facilitate restarting, and the occurrence of dieseling and run-on is prevented without providing a fuel cut valve to the carburetor. Further, a spring is provided to urge the throttle valve in an opening direction. With this, the response in opening the throttle valve is enhanced and the size of the motor is reduced.

6 Claims, 10 Drawing Sheets

THROTTLE DEVICE FOR MULTIPURPOSE ENGINE

BACKGROUND OF THE INVENTION

1. Field of the Invention

The present invention relates to a throttle device for a multipurpose engine, and more particularly relates to a throttle device for a multipurpose engine that is configured such that a throttle valve opens and closes with the aid of an actuator.

2. Description of the Related Art

In multipurpose engines such as spark ignition internal combustion engines used as drive sources for electrical generators, farming machinery, and various other applications, the opening of the throttle valve is usually adjusted by a mechanical governor made up of a weight and spring to control the engine speed.

A technique has recently been proposed for the precision control of the engine speed using an electronically controlled throttle device (i.e., an electronic governor) for opening and closing the throttle valve in this type of multipurpose engine with the aid of a stepping motor or other actuator.

Operation of the multipurpose engine is usually stopped by discontinuing or cutting the ignition. The throttle opening of the multipurpose engine at this time is held fully open or half open in view of the structural features of the mechanical governor or in order to enhance the restarting properties of the engine. However, since most multipurpose engines use a carburetor as a fuel supply device, when the throttle valve is held open when operation is stopped, the supply of fuel is not immediately stopped, and dieseling or run-on can occur.

Therefore, the conventional design has included a fuel cut valve (solenoid valve) disposed along the fuel channel of the carburetor, and the fuel cut valve is closed such that the supply of fuel is blocked simultaneously with the discontinuing of ignition, as taught in Japanese Laid-Open Patent Application No. 2003-120422, for example.

However, when a fuel cut valve is disposed along the fuel channel of the carburetor as described above, drawbacks arise whereby the structure of the carburetor becomes complex, which leads to increased size and cost of the carburetor.

Aside from the above, in an electronically controlled throttle device, it is generally the case that a valve shaft for carrying the throttle valve is connected with an actuator by a speed reduction gear mechanism, and the output of the actuator is transmitted to the throttle valve. The throttle valve is adapted to be urged in or towards the closed position by a return spring or other urging member, as taught in Japanese Laid-Open Patent Application Nos. 2001-263098 (paragraph 0008 and others) and 2003-83093 (paragraph 0007 and others).

When the throttle valve is to be opened from a fully closed position, since the throttle valve is urged in or towards the closed position, it takes a time until the throttle valve is actually opened due to the backlash effect of the speed reduction gear mechanism, disadvantageously rendering response to be inadequate. This will be the same even when no urging force is applied in the closed position.

Further, a torque, more precisely pressure in the valve closing direction also acts on the throttle valve due to the flow of intake air. A drive force that is larger than the combined force of the urging force of the urging member and the pressure of the intake air is therefore required in order to open the throttle valve, thus creating the drawback of having to increase the size of the actuator for opening and closing the throttle valve.

SUMMARY OF THE INVENTION

Therefore, a first object of the present invention is to overcome the drawbacks described above and to provide a throttle device for a multipurpose engine in which the throttle valve can be surely opened when the multipurpose engine is stopped to enhance the restarting properties thereof, and the occurrence of dieseling and run-on is prevented without providing a fuel cut valve to the carburetor, thus simplifying the structure of the carburetor.

A second object of the present invention is to overcome the drawbacks described above and to provide a throttle device for a multipurpose engine in which the response of the throttle valve when it is opened from a fully closed position is enhanced while the throttle valve and the actuator are connected via a speed reduction gear mechanism and the throttle valve is opened or closed by the actuator, and in which the size of the actuator is reduced.

In order to achieve the first object, there is provided a throttle device for a multipurpose internal combustion engine, comprising: a throttle valve disposed at an air intake passage of the engine; an actuator mechanically connected to the throttle valve; a controller electrically connected to the actuator and controlling operation of the actuator to move the throttle valve such that an amount of air passing through the air intake passage is regulated; an engine stop switch disposed to generate a signal indicating that an instruction to stop the engine is inputted by an operator; and a carburetor injecting fuel through a fuel passage communicated in the air intake passage upstream from the throttle valve; wherein, when the instruction to stop the engine is inputted through the engine stop switch, the controller controlling the operation of the actuator to move the throttle valve in a fully closed position so as to stop operation of the engine, and then to move the throttle valve in a fully opened direction.

In order to achieve the second object, there is provided a throttle device for a multipurpose internal combustion engine, comprising: a throttle valve carried by a valve shaft to be disposed at an air intake passage of the engine; an actuator mechanically connected to the valve shaft through a speed reduction gear mechanism; a controller electrically connected to the actuator and controlling operation of the actuator to rotate the valve shaft through the speed reduction gear mechanism so as to move the throttle valve such that an amount of air passing through the air intake passage is regulated; and a member urging the throttle valve in a direction in which the throttle valve is opened.

BRIEF DESCRIPTION OF THE DRAWINGS

The above and other objects and advantages of the invention will be more apparent from the following description and drawings, in which.

DESCRIPTION OF THE PREFERRED EMBODIMENTS

Preferred embodiments for implementing the throttle device for a multipurpose engine according to the present invention will be described hereinafter with reference to the accompanying drawings.

Figure 1:
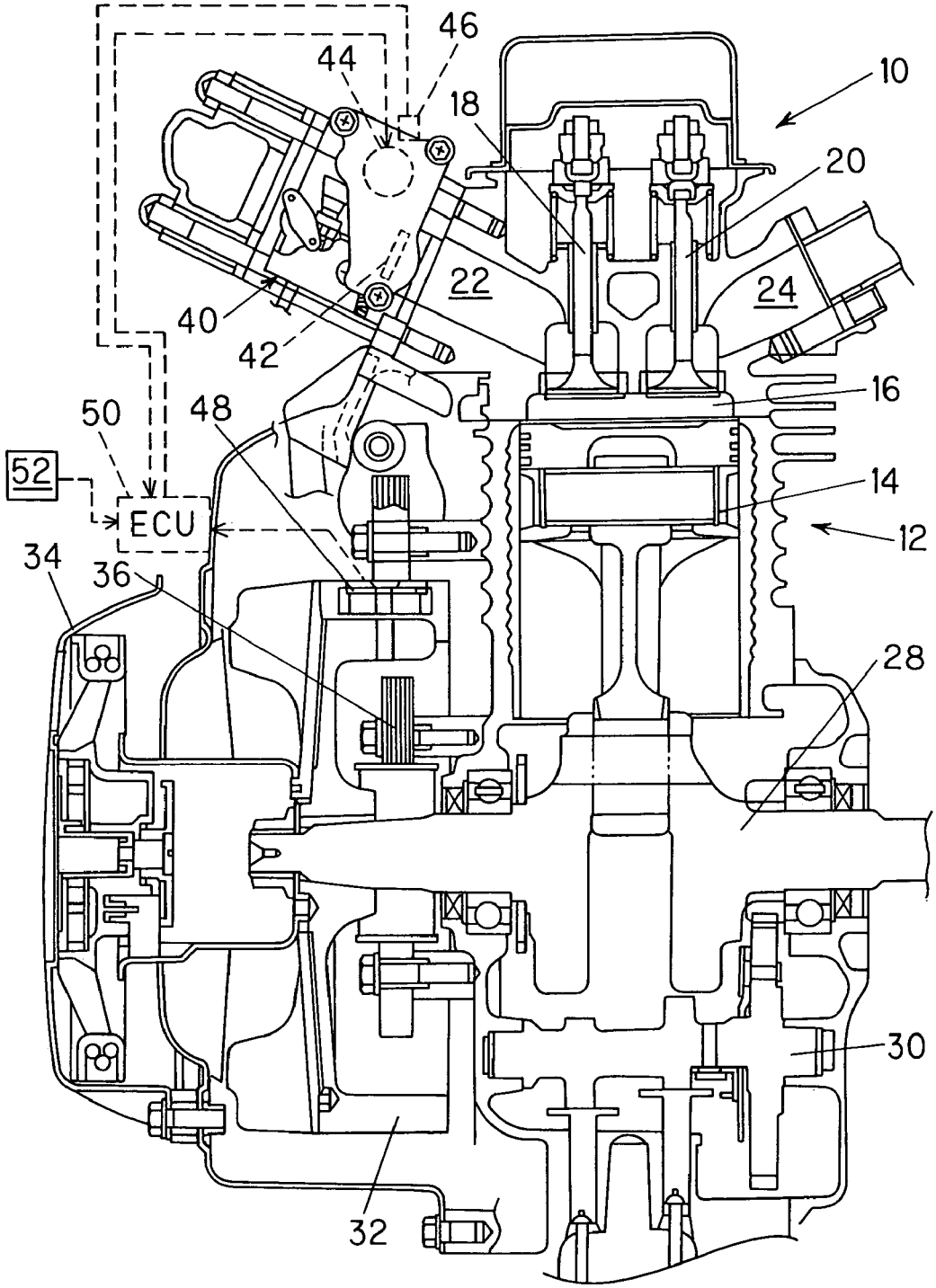
FIG. 1 is a schematic view of the entire throttle device for a multipurpose engine according to the present invention.

FIG. 1 is a schematic view of the entire throttle device for a multipurpose engine according to the invention.

"10" in FIG. 1 indicates a multipurpose engine (hereinafter simply referred to as "engine"). The engine 10 has a single cylinder 12, and the cylinder accommodates a piston 14 capable of reciprocating therein. A combustion chamber 16 is formed in the space between the head of the piston 14 and the surface of the cylinder wall, and an intake valve 18 and an exhaust valve 20 are disposed in the cylinder wall to form or terminate a connection between the combustion chamber 16 and an air intake passage 22 or exhaust passage 24. The engine 10 specifically comprises a water-cooled four-cycle single cylinder OHV-type internal combustion engine with a volume displacement of 196 cc.

The piston 14 is connected to a crankshaft 28, and the crankshaft 28 is connected to a camshaft 30 via a gear. A flywheel 32 is mounted on the crankshaft 28, and a recoil starter 34 for allowing the operator to manually start the engine 10 is also mounted at the leading end of the flywheel 32. A generating coil (alternator) 36 is disposed on the inside of the flywheel 32, and the coil generates an alternating electrical current. The alternating current generated by the generating coil 36 is converted to a direct current via a processing circuit (not shown), and is then supplied as the source of operating power to ECU (Electronic Control Unit), electric motor, ignition circuit (not shown), and other components described hereinafter. The engine 10 is also a batteryless-type multipurpose engine that is not provided with a battery.

A carburetor 40 is disposed upstream in the air intake passage 22. The carburetor 40 contains a throttle valve 42, and the throttle valve 42 is mechanically connected to an electric motor (an actuator, or, specifically, a stepping motor, DC motor, or the like) 44 via the valve shaft and speed reduction gear mechanism described hereinafter. The carburetor 40 is connected to a fuel tank (not shown), and the carburetor 40 injects gasoline fuel into air drawn in accordance with the opening of the throttle valve 42 to generate a fuel-air mixture. The fuel-air mixture thus generated is drawn into the combustion chamber 16 of the cylinder 12 through the throttle valve 42, air intake passage 22, and intake valve 18.

A throttle position sensor 46 is disposed near the electric motor 44, and the sensor outputs a signal indicative of the position or opening θTH (hereinafter referred to as "throttle opening") of the throttle valve 42. A crank angle sensor 48 made up of an electromagnetic pickup is also disposed in the vicinity of the flywheel 32, and the sensor outputs a pulse signal at prescribed crank angle increments.

The ECU (now assigned with "50") is disposed near the engine 10. The ECU 50 is made up of a microcomputer and is provided with a CPU, ROM, RAM, counter, and the like (not shown). An engine stop switch 52 is also disposed in an appropriate position in the engine 10. The engine stop switch 52 outputs an ON signal when an instruction or command to stop the engine is inputted from the operator (when the switch is operated).

The outputs of the aforementioned throttle position sensor 46, crank angle sensor 48, and engine stop switch 52 are inputted into the ECU 50. The ECU 50 counts the output pulses of the crank angle sensor 48 and detects (computes) the engine speed NE.

The ECU 50 computes the electric current command value of the electric motor 44 such that the detected engine speed NE becomes equal to a desired engine speed NED based on the detected engine speed NE and the throttle opening θTH, and outputs the computed electric current command value to the electric motor 44 to control the operation of the electric motor 44. When the instruction to stop the engine is inputted via the engine stop switch 52, the ECU 50 also operates the electric motor 44 to adjust the throttle opening θTH, and discontinues or cuts the ignition to stop operation of the engine 10. The ECU 50 is thus electrically connected to the electric motor 44.

Thus, in the present embodiment, the engine speed NE is controlled by the electronically controlled throttle device (electronic governor) made up of the throttle valve 42 disposed in the air intake passage 22 of the engine 10, the electric motor 44 connected to the throttle valve 42, and the ECU 50 for opening and closing the throttle valve 42 and adjusting the amount of intake air by controlling the operation of the electric motor 44.

Figure 2:
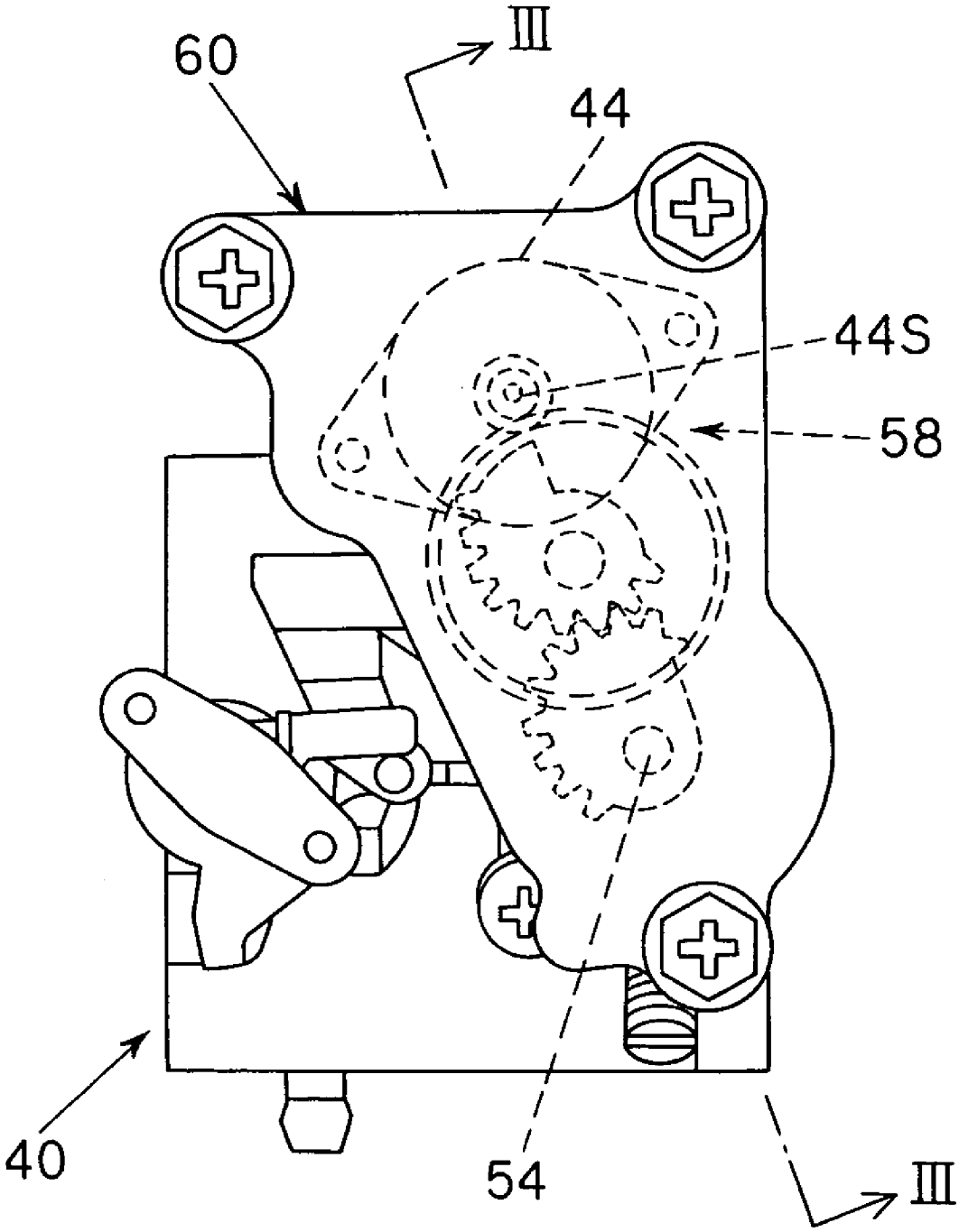
FIG. 2 is a plan view of the carburetor shown in FIG. 1.
Figure 3:
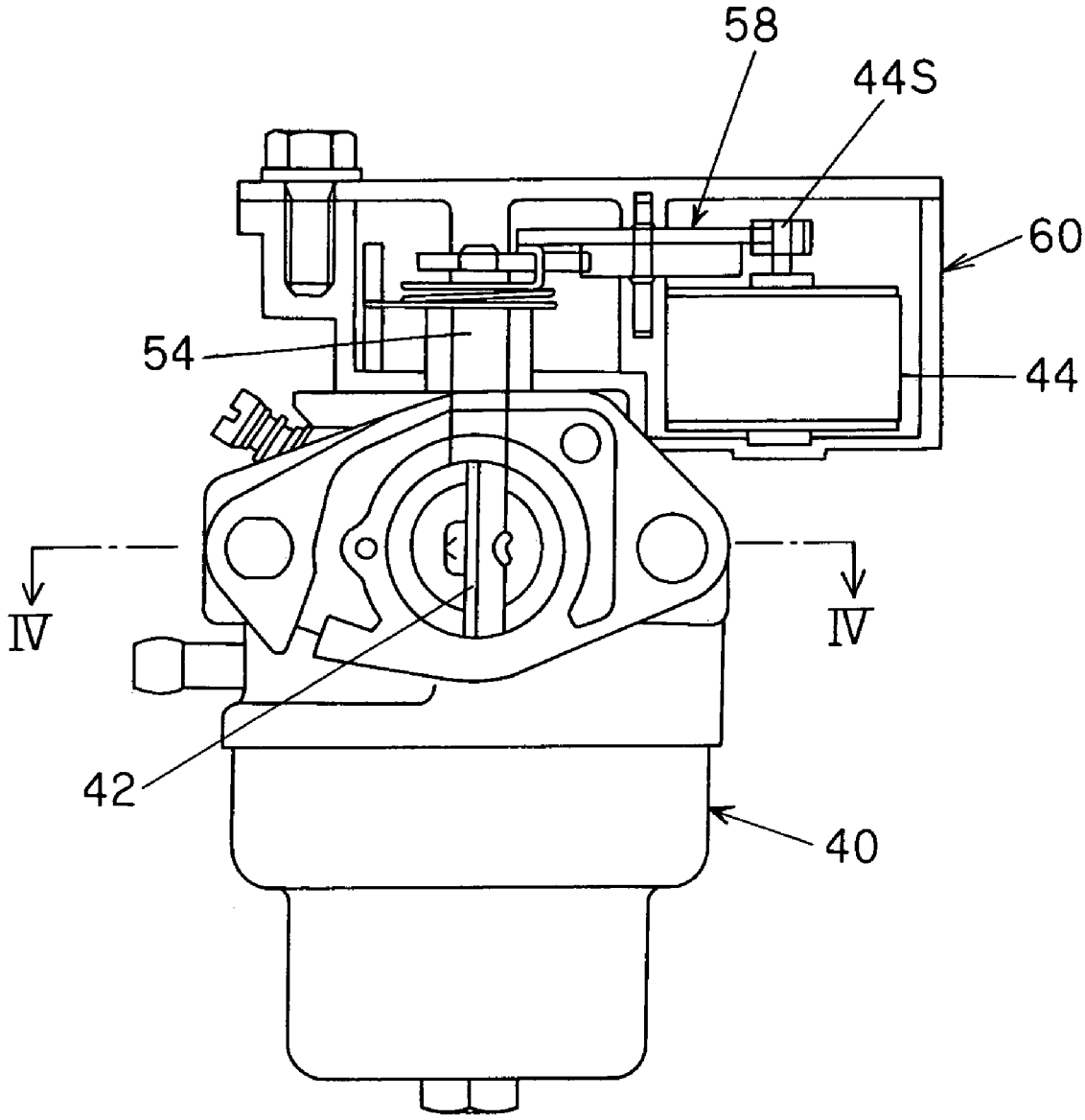
FIG. 3 is a cross-sectional view taken along line III—III of FIG. 2.

FIG. 2 is a plan view of the carburetor 40. FIG. 3 is a cross-sectional view taken along line III—III of FIG. 2.

As shown in FIG. 3, the throttle valve 42 is disposed in the carburetor 40. The throttle valve 42 is carried or supported by a valve shaft 54. The valve shaft 54 is connected to an output shaft 44S of the electric motor 44 via a speed reduction gear mechanism 58. The electric motor 44, the speed reduction gear mechanism 58, and a portion of the valve shaft 54 are contained inside a unit case 60 mounted in integral fashion in the throttle body.

Figure 4:
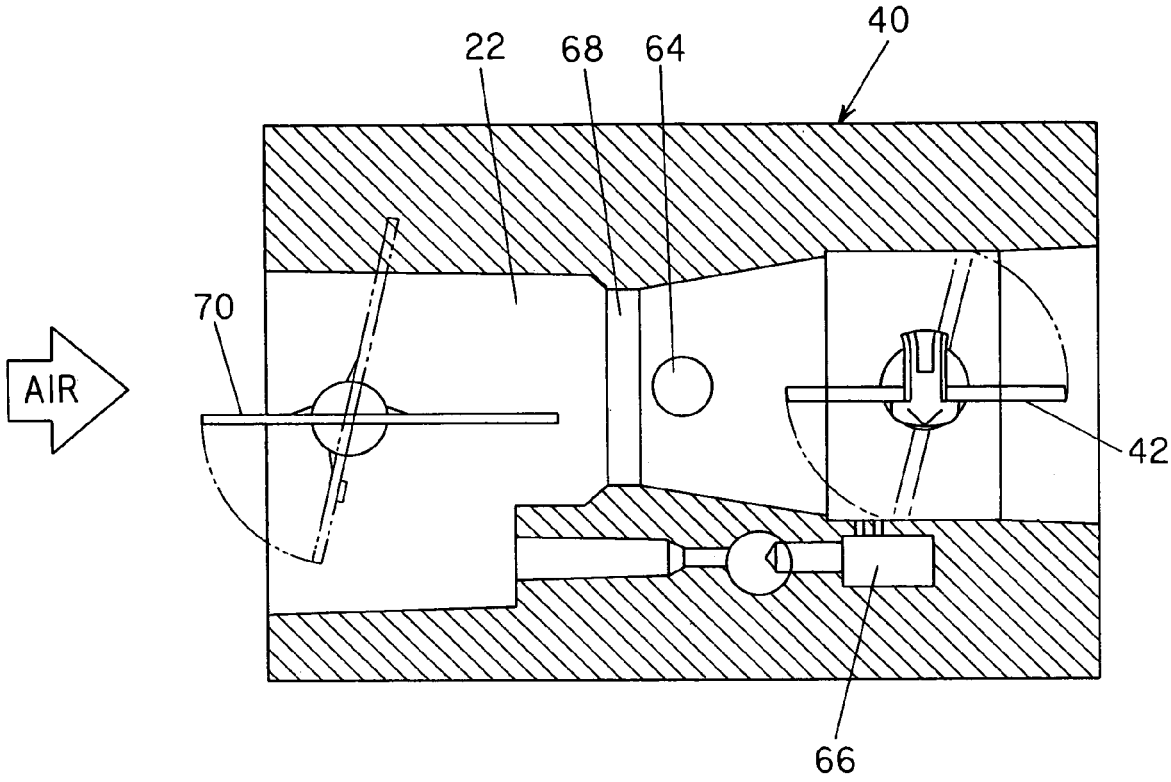
FIG. 4 is a cross-sectional view taken along line IV—IV of FIG. 3.

FIG. 4 is a cross-sectional view taken along line IV—IV of FIG. 3.

As shown in FIG. 4, a main fuel passage 64 and a slow fuel passage 66 are communicated with the upstream end from the throttle valve 42 of the air intake passage 22 inside the carburetor 40. The main fuel passage 64 and the slow fuel passage 66 are connected to the fuel tank via a float chamber or the like (not shown). A venturi 68 is also formed near the main fuel passage 64, and a choke valve 70 is disposed upstream from the venturi 68.

To briefly describe the fuel injection operation of the carburetor 40, widely opening the throttle valve 42 causes fuel to be injected from the main fuel passage 64 by the negative pressure of the intake air passing through the venturi 68, and a fuel-air mixture is generated. On the other hand, slightly opening the throttle valve 42 causes fuel to be injected from the slow fuel passage 66 by the negative pressure primarily generated by the lowering of the piston 14 (not shown in FIG. 4). During a cold start, the air/fuel ratio is enriched by closing the choke valve 70 and reducing the amount of intake air.

Since most multipurpose engines are operated at a constant speed (about 2500 rpm, for example) in a high speed region, a low engine speed region (1000 rpm or less, for example) in the vicinity of idling speed is not needed. In view of this, the present embodiment is intentionally designed not to have an idle port (a fuel channel running downstream from the throttle valve 42) in order to simplify the structure of the carburetor 40. In the engine 10 according to the present embodiment, the supply of fuel is cut and operation is stopped when the throttle valve 42 is fully closed.

Figure 5:
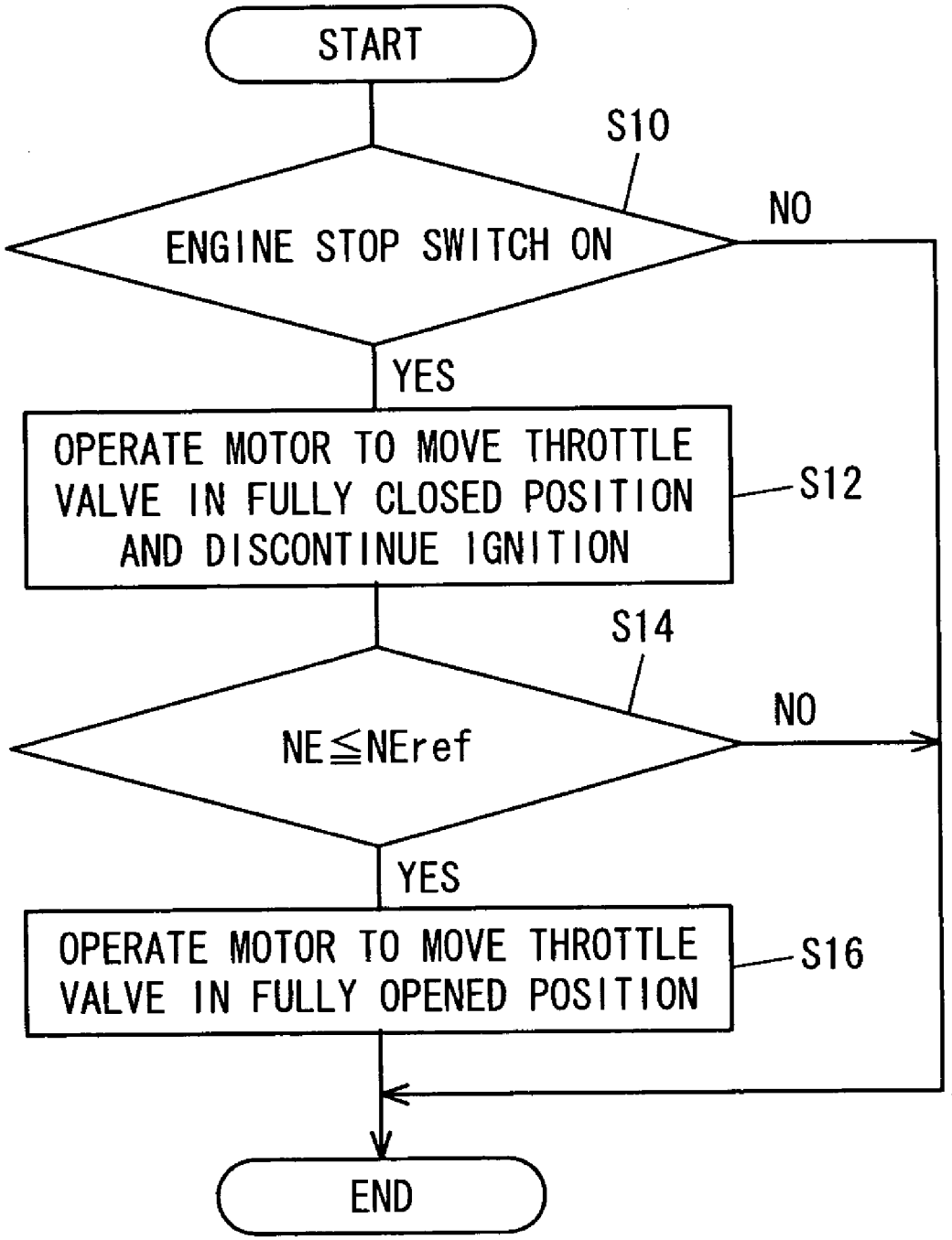
FIG. 5 is a flowchart of the operation of the device in FIG. 1.

The operation of the throttle device for a multipurpose engine according to the present embodiment; specifically, the throttle opening control performed when the engine 10 is stopped, will next be described with reference to FIG. 5. FIG. 5 is a flowchart showing this operation. The program shown in the figure is executed with a prescribed period (100 msec, for example).

To begin this description, it is first determined in S10 whether the engine stop switch 52 generates an ON signal, or, specifically, whether the instruction to stop the engine 10 has been inputted by the operator. Subsequent processing is skipped if the result of S10 is negative. On the other hand, if the result of S10 is positive, the process proceeds to S12 in which the electric motor 44 is operated so as to move the throttle valve 42 in the fully closed position, the ignition is discontinued or cut such that operation of the engine 10 is to be stopped.

Since the carburetor 40 in this arrangement is not provided with the aforesaid fuel channel disposed downstream from the throttle valve 42, the cutting of fuel supply by the complete closure of the throttle valve 42 is performed as described above. Therefore, dieseling and run-on after the discontinuing or cutting of ignition can be prevented by operating the electric motor 44 so as to move the throttle valve 42 in the fully closed position in S12.

The process then proceeds to S14 in which it is determined whether the engine speed NE has dropped to or below a prescribed engine speed NEref. The prescribed engine speed NEref is set to a value (800 rpm, for example) at which the operation of the engine 10 will not recover even if the throttle valve 42 is opened after the engine speed NE has dropped to a engine speed that is at or below that value.

Subsequent processing is skipped if the result of S14 is negative. On the contrary, if the result of S14 is positive, the process proceeds to S16 in which the electric motor 44 is operated so as to move the throttle valve 42 in the fully opened position. The throttle valve 42 is opened in this arrangement in order to enhance the restarting properties of the engine 10.

Since the engine 10 is not provided with a battery and the electric motor 44 uses electrical power generated by the rotation of the engine 10 (rotation of the flywheel 32) as its source of operating power, the throttle valve 42 can no longer be opened when the engine 10 is completely stopped. In view of this, a configuration is adopted such that the throttle valve 42 is opened when the engine speed NE has decreased to or below the prescribed engine speed NEref, or, specifically, before the engine 10 is completely stopped (before electrical power ceases to be generated), as described above. The series of operations from the valve closing in order to prevent dieseling and the like to the valve opening in order to enhance restarting properties can thereby be performed even if the multipurpose engine is not provided with a battery. Since the engine speed NE has decreased to or below the above-mentioned prescribed engine speed NEref, operation of the engine cannot be recovered and the engine remains stopped even if the throttle valve 42 is opened.

Thus, in the throttle device for a multipurpose engine according to the present embodiment, the main fuel passage 64 and slow fuel passage 66 of the carburetor 40 are communicated in the air intake passage 22 upstream from the throttle valve 42, and when the instruction to stop the engine 10 is inputted via the engine stop switch 52, the electric motor 44 is operated so as to move the throttle valve 42 in the fully closed position such that the operation of the engine 10 is to be stopped and then, more precisely, if the engine speed NE drops to or below the prescribed engine speed NEref, the electric motor 44 is operated to move the throttle valve 42 in the fully open position. With this, dieseling and run-on can be prevented without providing a fuel cut valve, which had been necessary in the conventional carburetor 40, and thus the structure of the carburetor 40 can be simplified. Since the throttle valve 42 is opened when the engine speed NE has adequately decreased to or below the prescribed engine speed NEref, the engine can be restarted more easily.

Further, since the source of operating power for the electric motor 44 is limited to the electric power generated by the rotation of the engine 10, the series of operations from the valve closing to prevent dieseling and the like to the valve opening to enhance restarting can be completed during the time in which operating power is supplied to the electric motor 44 (specifically, while power continues to be generated). The effects described above can therefore be obtained even when the multipurpose engine is not provided with a battery, as in the engine 10 of the present embodiment.

Since the prescribed engine speed NEref is set to a value whereafter the operation of the engine 10 will not recover even if the throttle valve 42 is opened, operation of the engine 10 can therefore be reliably stopped.

Figure 6:
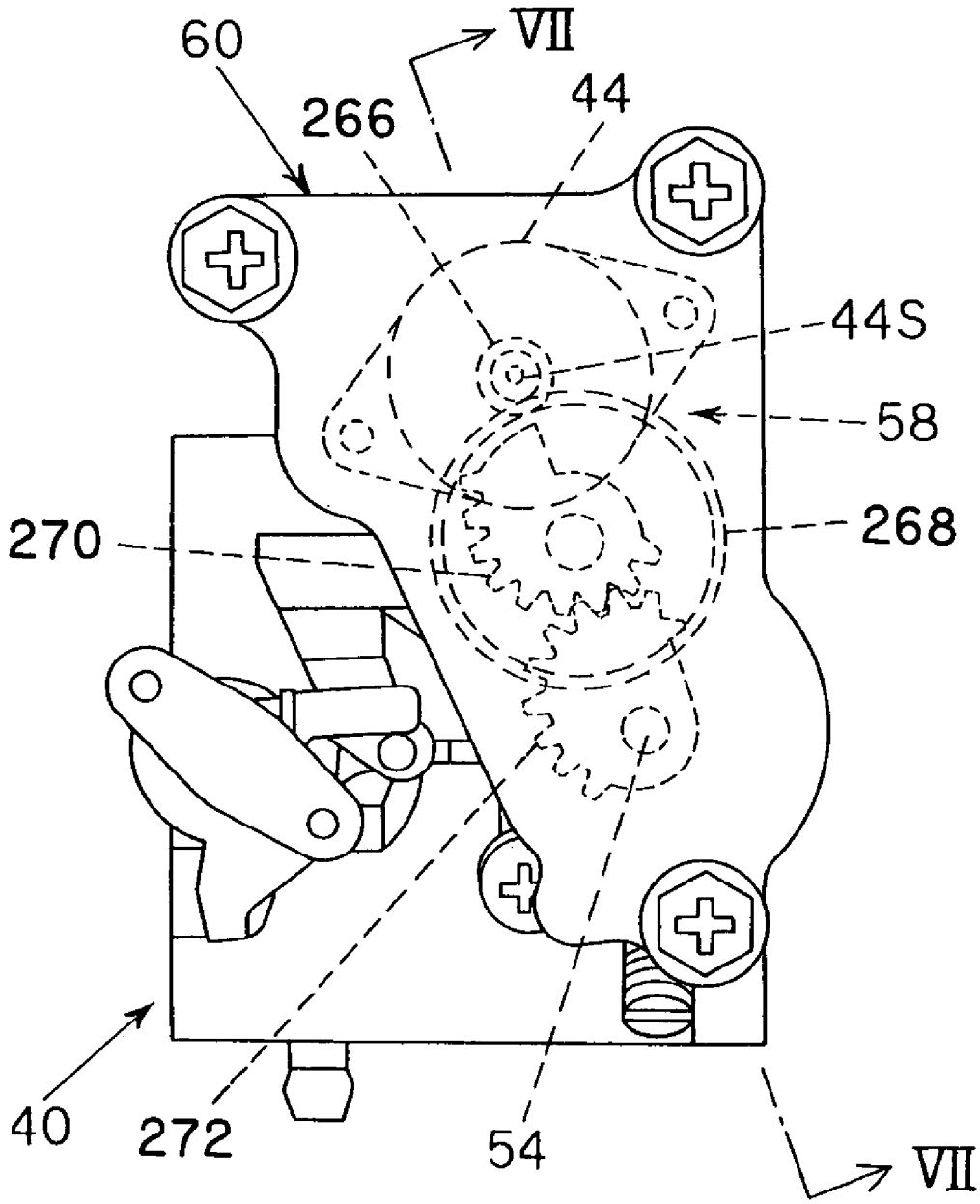
FIG. 6 is a plan view of the carburetor shown in FIG. 1.
Figure 7:
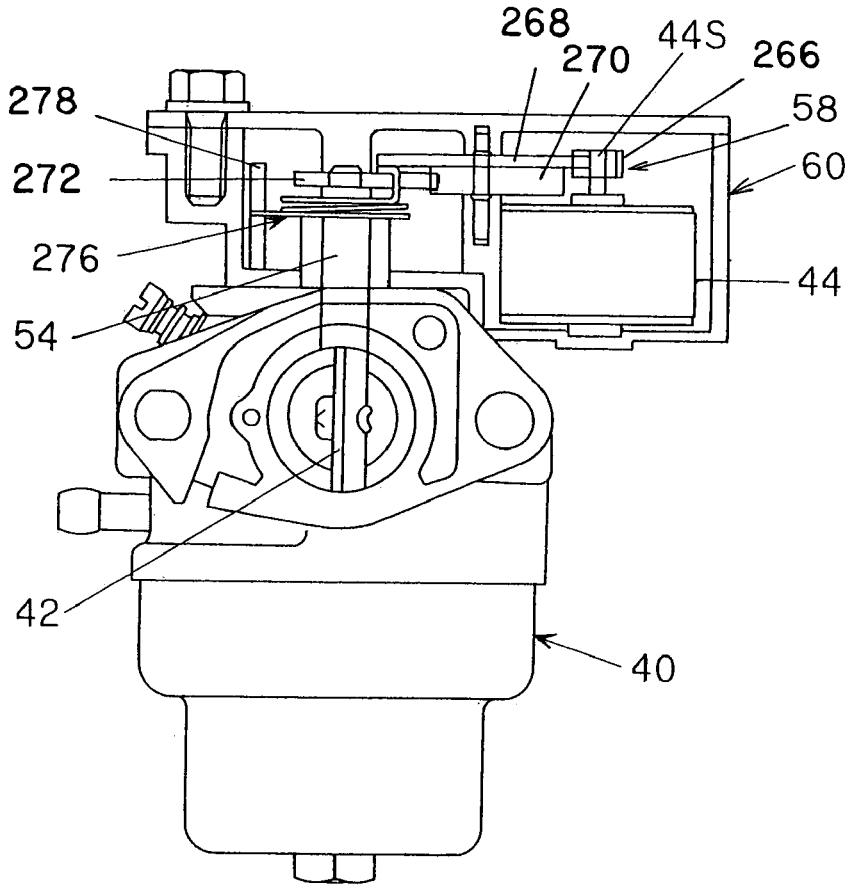
FIG. 7 is a cross-sectional view taken along line VII—VII of FIG. 6.

The throttle device for a multipurpose engine according to a second embodiment of the present invention will next be described with reference to FIG. 6 and subsequent figures. FIG. 6 is a plan view showing the carburetor 40 of the device. FIG. 7 is a cross-sectional view taken along line VII—VII of FIG. 6.

As shown in FIGS. 6 and 7, the speed reduction gear mechanism 58 is provided with four gears. Describing the speed reduction gear mechanism 58 in detail, a first gear 266 is mounted on the output shaft 44S of the electric motor, and the first gear 266 is meshed with a second gear 268 that is rotatably supported in the unit case 60. A third gear 270 is mounted on the same shaft as the second gear 268, and the third gear 270 is meshed with a fourth gear 272 mounted on the valve shaft 54. The output of the electric motor 44 is thereby transmitted to the valve shaft 54 while reduced in speed according to the gear ratio of the gears, and the throttle valve 42 is opened and closed.

The third gear 270 and fourth gear 272 are eccentric gears, as is clearly shown in FIG. 6. More specifically, the third gear 270 and fourth gear 272 are set such that the angle of rotation of the fourth gear 272 with respect to the angle of rotation of the third gear 270 decreases (the speed reduction ratio increases) as the throttle opening θTH is reduced. This arrangement takes into consideration the fact that the pressure difference between upstream and downstream of the throttle valve 42 decreases and ultimately reaches saturation as the throttle opening θTH becomes larger (specifically, the variation in the amount of intake air passing through the throttle valve 42 widens with a reduction in the throttle opening θTH). By performing the setting described above, it becomes possible to finely adjust the opening when the throttle opening θTH is small and to adjust the opening at a high opening and closing speed when the throttle opening θTH is large. With this, the desired engine speed can be followed with good precision and response.

Figure 8:
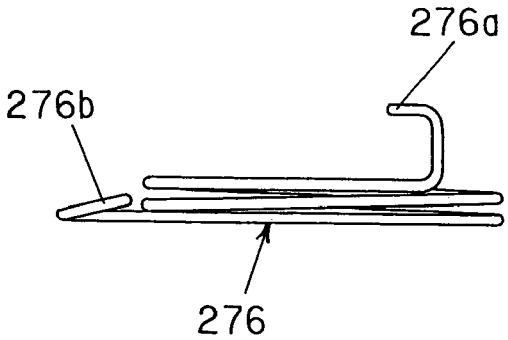
FIG. 8 is an enlarged side view of the return spring shown in FIG. 7.

As shown in FIG. 7, a return spring (member) 276 is disposed inside of the unit case 60 around the valve shaft 54. The return spring 276 comprises a torsion coil spring, as shown in FIG. 8. One end 276*a* of the return spring 276 is connected to the fourth gear 272 mounted on the valve shaft 54, and the other end 276*b* is connected to a hook pin 278 protruding into the unit case 60. Also, the coil direction of the return spring 276 is set so that the valve shaft 54 is rotated in the direction of opening the throttle valve 42.

Specifically, in the present embodiment, the return spring 276 that urges the throttle valve 42 in the valve opening direction (full opening direction) is provided to the throttle device for a multipurpose engine that comprises the throttle valve 42 disposed in the air intake passage 22 of the engine 10, the valve shaft 54 that carries or supports the throttle valve 42, and the electric motor 44 connected to the valve shaft 54 via the speed reduction gear mechanism 58 so that the valve shaft 54 is rotated via the speed reduction gear mechanism 58 by operating the electric motor 44, thereby opening and closing the throttle valve 42 to adjust the amount of intake air. The reason for this is described hereinafter.

Figure 9:
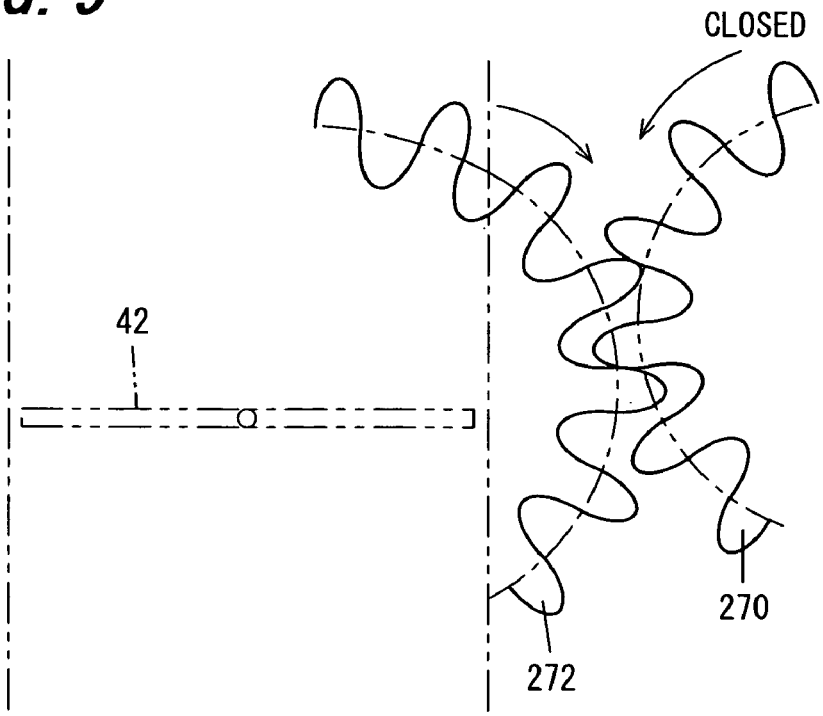
FIG. 9 is a schematic diagram of the third gear, the fourth gear, and the throttle valve shown in FIG. 7.

FIG. 9 is a schematic view depicting the third gear 270, the fourth gear 272, and the throttle valve 42. As shown in FIG. 9, the throttle valve 42 is brought to the fully closed position via the fourth gear 272 by actuating the third gear 270 in the direction in which the throttle valve 42 is closed by the electric motor 44 (not shown in this figure).

Figure 10:
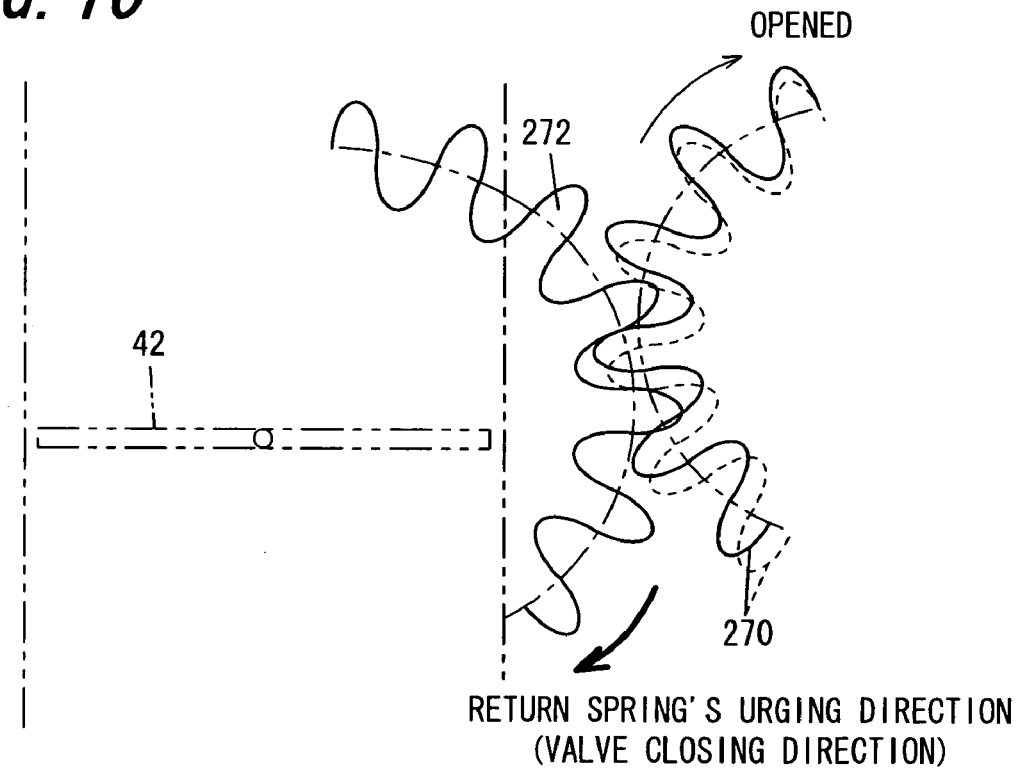
FIG. 10 is a schematic diagram of the third gear, the fourth gear, and the throttle valve shown in FIG. 7, presented in the same manner.

In this arrangement, when the throttle valve 42 is urged in the valve closing direction by the return spring 276 as in the conventional technique, the fourth gear 272 does not begin to rotate immediately when affected by backlash with the third gear 270 even when the third gear 270 is actuated in the direction in which the throttle valve 42 is opened after the throttle valve 42 is fully closed, as shown in FIG. 10. Specifically, a timing lag exists between the time at which opening of the throttle valve 42 is required and the time when it is actually opened, resulting in unacceptably poor response.

Figure 11:
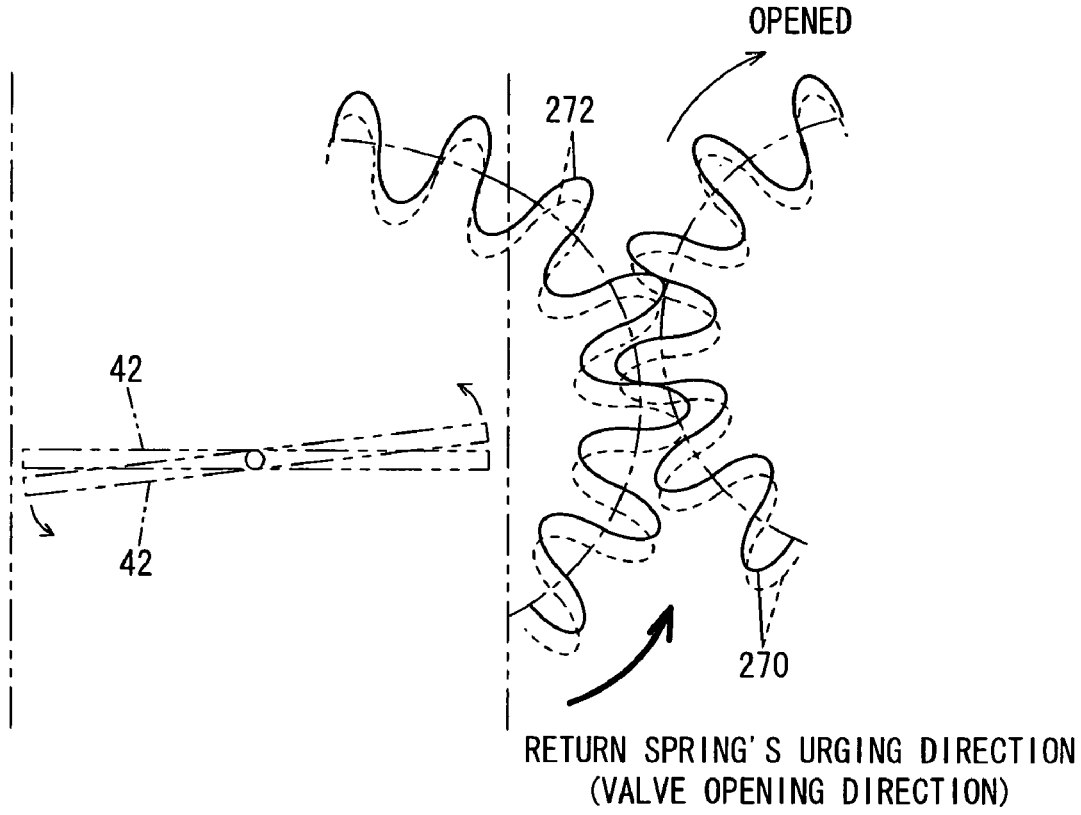
FIG. 11 is a schematic diagram of the third gear, the fourth gear, and the throttle valve shown in FIG. 7, presented in the same manner.

When the throttle valve 42 is urged in the valve opening direction by the return spring 276, the third gear 270 is actuated in the direction in which the throttle valve 42 opens after the throttle valve 42 is fully closed, whereupon, as shown in FIG. 11, the fourth gear 272 begins to rotate while caused to follow the rotation of the third gear 270 by the urging force of the return spring 276. Specifically, by urging the throttle valve 42 in the valve opening direction by the return spring 276, the throttle valve 42 begins to open immediately without being affected by the backlash of the third gear 270 and fourth gear 272.

Figure 12:
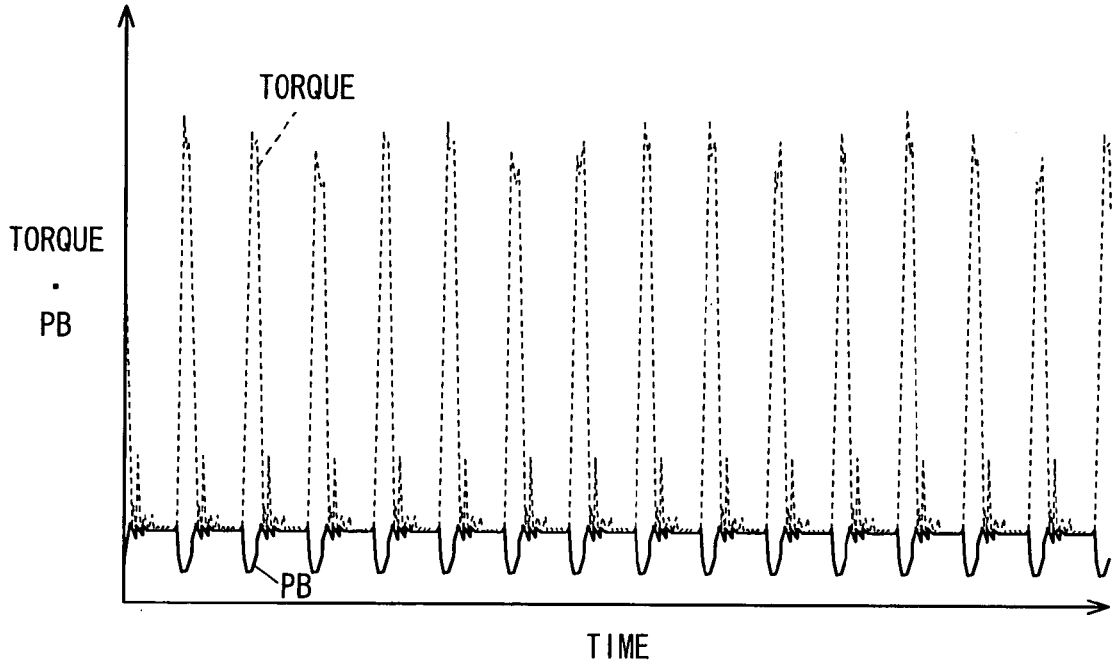
FIG. 12 is a graph showing the relationship between the pressure inside the intake line (passage) of the device shown in FIG. 1 and the torque in the valve closing direction acting on the throttle valve.

A torque, i.e., pressure in the valve closing direction also acts on the throttle valve 42 due to the flow of intake air. FIG. 12 is a graph showing the relationship between the pressure PB inside the air intake passage and the torque in the valve closing direction acting on the throttle valve 42. In this figure, when the pressure PB in the air intake passage (indicated by the solid line) decreases (as the negative pressure increases), torque (indicated by the dashed line) in the valve closing direction acts on the throttle valve 42. This torque resists opening of the throttle valve 42, so the electric motor 44 must generate a large drive force.

However, since the present embodiment is designed such that the throttle valve 42 is urged in the valve opening direction by the return spring 276, the torque in the valve closing direction acting on the throttle valve 42 due to the flow of intake air and the urging force (torque in the valve opening direction) of the return spring 276 are able to cancel each other out, whereby the drive force needed to open the throttle valve 42 can be reduced.

Thus, in the second embodiment of the present invention, since the return spring 276 is provided for urging the throttle valve 42 in the valve opening direction, the response of the throttle valve 42 as it opens from the fully closed position can be enhanced without any effect from the backlash of the speed reduction gears (third gear 270 and fourth gear 272) when the throttle valve is opened from the fully closed position. Since the torque in the valve closing direction that acts on the throttle valve 42 due to the flow of intake air and the urging force (torque in the valve opening direction) of the return spring 276 also cancel each other out, the drive force needed to open the throttle valve 42 can be reduced, thereby enabling the size of the electric motor 44 for opening and closing the throttle valve 42 to be reduced.

Thus, the first and second embodiments are configured to have a throttle device for a multipurpose internal combustion engine 10, comprising: a throttle valve 42 disposed at an air intake passage 22 of the engine; an actuator (electric motor 44) mechanically connected to the throttle valve 42; a controller (ECU 50) electrically connected to the actuator and controlling operation of the actuator to move the throttle valve 42 such that an amount of air passing through the air intake passage is regulated; an engine stop switch 52 disposed to generate a signal indicating that an instruction to stop the engine is inputted by an operator; and a carburetor 40 injecting fuel through a fuel passage 64, 66 communicated in the air intake passage upstream from the throttle valve 42; wherein, when the instruction to stop the engine is inputted through the engine stop switch, the controller controlling the operation of the actuator to move the throttle valve 42 in a fully closed position so as to stop operation of the engine (S10–S12), and then to move the throttle valve in a fully opened direction (S14–S16).

The device further includes; a generating coil 36 generating electric power in response to rotation of the engine 10; and the actuator is an electric motor 44 that is operated by the electric power generated by the generating coil 36.

The device further includes: an engine speed detector (crank angle sensor 48, ECU 50) detecting a speed of the engine (NE); and wherein the controller controls the operation of the actuator to move the throttle valve 42 in the fully closed position, and when the detected engine speed NE drops to or below a prescribed engine speed NEref, controls the operation of the actuator to move the throttle valve 42 in the fully opened direction (S14–S16).

In the device, the prescribed engine speed NEref is set to a value (e.g., 800 rpm) whereby the operation of the engine 10 will not recover even if the throttle valve 42 is opened.

Further, the first and second embodiments are configured to have a throttle device for a multipurpose internal combustion engine 10, comprising: a throttle valve 42 carried by a valve shaft 54 to be disposed at an air intake passage 22 of the engine; an actuator (electric motor 44) mechanically connected to the valve shaft through a speed reduction gear mechanism 58; a controller (ECU 50) electrically connected to the actuator and controlling operation of the actuator to rotate the valve shaft through the speed reduction gear mechanism so as to move the throttle valve 42 such that an amount of air passing through the air intake passage is regulated; and a member (a torsion coil spring 276) urging the throttle valve 42 in a direction in which the throttle valve is opened.

In the device, the member comprises a spring 276 that urges the throttle valve 42 in the direction in which the throttle valve is opened.

In the device, the speed reduction gear mechanism 58 includes a first gear 266 connected to an output shaft 44S of the actuator 44, a second gear (third gear 270) meshed with the first gear and a third gear (fourth gear 272) meshed with the second gear and connected to the valve shaft 54, and the spring 276 is connected to the third gear such that the valve shaft 54 is rotated in the direction in which the throttle valve 42 is opened.

In the device, the second gear (third gear 270) and the third gear (fourth gear 272) are made eccentric such that an angle of rotation of the third gear with respect to the angle of rotation of the second gear decreases as the throttle valve 42 is closed.

It should be noted in the above that, although the one end 276*a* of the return spring 276 is connected to the fourth gear 272, this connection may also be with the valve shaft 54 or with another member fixed to the valve shaft 54, if such a member is present.

It should also be noted that, although the return spring 276 is designed to be a torsion coil spring, it may be another type of spring. Rubber or another elastic body may also be used instead of a spring.

It should be further noted that, although the electric motor 44 is cited as the actuator for opening and closing the throttle valve 42, a rotary solenoid or other actuator may instead be used.

Japanese Patent Application Nos. 2003-307412 and 2003-307414, both filed on Aug. 29, 2003, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A throttle device for a multipurpose internal combustion engine, comprising:

a throttle valve disposed at an air intake passage of the engine;

an actuator mechanically connected to the throttle valve;

a controller electrically connected to the actuator and controlling operation of the actuator to move the throttle valve such that an amount of air passing through the air intake passage is regulated;

an engine stop switch disposed to generate a signal indicating that an instruction to stop the engine is inputted by an operator; and a carburetor injecting fuel through a fuel passage communicated in the air intake passage upstream from the throttle valve;

wherein, when the instruction to stop the engine is inputted through the engine stop switch, the controller controlling the operation of the actuator to move the throttle valve in a fully closed position so as to stop operation of the engine, and then to move the throttle valve in a fully opened direction.

2. The throttle device according to claim 1, further including;

a generating coil generating electric power in response to rotation of the engine;

and the actuator is an electric motor that is operated by the electric power generated by the generating coil.

3. The throttle device according to claim 1, further including;

an engine speed detector detecting a speed of the engine;

and wherein the controller controls the operation of the actuator to move the throttle valve in the fully closed position, and when the detected engine speed drops to or below a prescribed engine speed, controls the operation of the actuator to move the throttle valve in the fully opened direction.

4. The throttle device according to claim 3, wherein the prescribed engine speed is set to a value whereby the operation of the engine will not recover even if the throttle valve is opened.

5. A throttle device for a multipurpose internal combustion engine, comprising:

a throttle valve carried by a valve shaft to be disposed at an air intake passage of the engine;

an actuator mechanically connected to the valve shaft through a speed reduction gear mechanism;

a controller electrically connected to the actuator and controlling operation of the actuator to rotate the valve shaft through the speed reduction gear mechanism so as to move the throttle valve such that an amount of air passing through the air intake passage is regulated; and a member urging the throttle valve in a direction in which the throttle valve is opened, wherein the member comprises a spring that urges the throttle valve in the direction in which the throttle valve is opened, wherein the speed reduction gear mechanism includes a first gear connected to an output shaft of the actuator, a second gear meshed with the first gear, a third gear mounted on the same shaft as the second gear, and a fourth gear meshed with the third gear and connected to the valve shaft, and the spring is connected to the fourth gear such that the valve shaft is rotated in the direction is which the throttle valve is opened.

6. The throttle device according to claim 5, wherein the third gear and the fourth gear are made eccentric such that an angle of rotation of the fourth gear with respect to the angle of rotation of the third gear decreases as the throttle valve is closed.

* * * * *